United States Patent [19]

Uchida et al.

[11] 4,116,684

[45] Sep. 26, 1978

[54] HIGH SPEED TOOL STEEL HAVING HIGH TOUGHNESS

[75] Inventors: Norimasa Uchida, Matsue; Kingo Kiyonaga, Yonago; Hideki Nakamura, Yasugi, all of Japan

[73] Assignee: Hitachi Metals, Ltd., Japan

[21] Appl. No.: 776,924

[22] Filed: Mar. 11, 1977

[30] Foreign Application Priority Data

Mar. 17, 1976 [JP] Japan ..... 51-28090

[51] Int. Cl.[2] ..... C22C 38/22; C22C 38/24; C22C 38/26; C22C 38/28

[52] U.S. Cl. ..... 75/126 C; 75/126 D; 75/126 E; 75/126 F; 75/126 H; 75/126 J; 148/36

[58] Field of Search ..... 148/36; 75/126 C, 126 E, 75/126 J, 126 H, 126 D, 126 F

[56] References Cited

U.S. PATENT DOCUMENTS

| | | | |
|---|---|---|---|
| 2,084,329 | 6/1937 | Emmons | 75/126 E |
| 2,147,121 | 2/1939 | Emmons | 75/126 E |
| 2,147,122 | 2/1939 | Emmons | 75/126 E |
| 2,983,601 | 5/1961 | Fletcher et al. | 75/126 E |
| 2,996,376 | 8/1961 | Nehrenberg | 75/126 E |
| 3,012,879 | 12/1961 | Schempp et al. | 75/126 E |
| 3,105,723 | 10/1963 | Hamaker, Jr. | 75/126 E |
| 3,295,966 | 1/1967 | Steven | 75/126 D |
| 3,850,621 | 11/1974 | Haberling et al. | 75/126 E |

FOREIGN PATENT DOCUMENTS

| | | | |
|---|---|---|---|
| 1,244,360 | 9/1971 | United Kingdom | 148/36 |
| 245,373 | 6/1967 | U.S.S.R. | 75/126 D |

*Primary Examiner*—Arthur J. Steiner
*Attorney, Agent, or Firm*—Craig & Antonelli

[57] ABSTRACT

A high speed tool steel having high toughness as well as excellent wear resistance and heat resistance characteristics, this steel contains, by weight, C 0.7 – 1.4%, Si 0.5% max., Mn 0.5% max., Cr 3 – 6%, W 1 – 3.2%, Mo 5.5 – 7.5%, V 1 – 3.5%, Co 15% max., N 0.02 – 0.1%, one or more of Ti, Nb, and Zr 0.02 – 0.1% in total and the balance being Fe and incidental impurities. The relationship between tungsten and molybdenum contents of the steel is expressed in the formulated range $12\% \leqq W + 2Mo \leqq 16\%$.

5 Claims, No Drawings

HIGH SPEED TOOL STEEL HAVING HIGH TOUGHNESS

The present invention relates to a high speed tool steel used for cutting tools such as taps, drills, cutters and cold working tools such as punches and dies. More particularly, this invention relates to a high speed tool steel having high toughness which solves the problems of breakage and chipping of said cutting tools during cutting operation and also meets the requirement of better heat and wear resistance especially for said cold working tools.

When cutting tools such as taps and pinion cutters are used, normally the cutting edges wear away gradually. In some instances, however, there occurs a sudden breakage or chipping of the cutting edge, resulting in early failure of the tool, thereby bringing about a lowering of production efficiency and degradation of product accuracy. When such problems are foreseen, the necessary toughness of the tool has been obtained by lowering the hardness of the tool: that is, at the sacrifice of the wear resistance property of the steel.

For cold working tools such as punches and dies which require extreme toughness, alloy tool steels are normally used. But these steels do not have completely sufficient heat resistance and wear resistance properties. Therefore, a material having better heat and wear resistance property as well as increased toughness has been desired. If we use high speed tool steels of AISI M2 type, giving precedence to heat and wear resistance, tool breakage and chipping due to insufficient toughness happen frequently.

For this this reason, a material that has not only a heat and wear resistance property equivalent to AISI M2 type steel, but also toughness exceeding that of AISI M2 has been desired.

The object of this invention is to provide a high speed tool steel superior in toughness and yet not inferior in wear and heat resistance to the conventional high speed tool steels.

The present invention provides a high speed tool steel having superior toughness which contains, by weight, C 0.7 - 1.4%; Si 0.5% max.; Mn 0.5% max.; Cr 3 - 6%; W 1 - 3.2%; Mo 5.5 - 7.5%; V 1 - 3.5%; Co 15% max.; N 0.02 - 0.1%; one or more of the elements selected from the group of Ti, Nb, and Zr and 0.02 - 0.1% in total; W and Mo contents being in the relationship expressed by $12\% \leqq W + 2Mo \leqq 16\%$.

First, W and Mo are the most important elements composing the steel in accordance with the present invention. Both W and Mo combine with added Cr, V, and C together and crystallize mainly as carbides in the form of $M_6C$. The $M_6C$ type carbides, however, exist segregated in the matrix in the form of stripes and it is well known that this accounts for the deterioration of toughness in high speed tool steels. Relation between the total added amount of W and Mo and the deterioration of the toughness is not clearly known. Test steels No. 1 - No. 8, each in 5 kg. ingots were prepared, in which ammounts of W and Mo were varied as shown in Table 1 (all values showing the contents are percentages by weight). Every test steel was forged to a 18 × 18 mm square bar, then annealed and machined into a 5.5 mm dia. × 70 mm piece for breakage test, and studied for studying the relationship between the total amounts of added W and Mo and the toughness thereof. The test pieces were oil quenched at the hardening temperatures as shown in Table 1, and were tempered at 560°- 600° C for 1 hour at least twice the hardnesses of the test pieces were 66° - 66.5° in Rockwell C scale. After heat-treatment, the test pieces were ground to 5.0 mm dia. × 70 mm pieces. Then, traverse bending test was carried out by applying the load upon one point at the center with the span set at 50 mm and its traverse bending stresses were determined. The results of the test are shown in Table 1.

Table 1

| No. | C | Cr | W | Mo | V | N | Ti | W + 2Mo | Hardening temp.° C | $\sigma_B$ Kg/mm² | $H_RC$ (650° C) |
|---|---|---|---|---|---|---|---|---|---|---|---|
| 1 | 0.78 | 4.21 | 0.52 | 4.28 | 1.83 | 0.012 | 0.005 | 9.10 | 1170 | 559 | 53.6 |
| 2 | 0.91 | 4.27 | 1.20 | 5.78 | 2.01 | 0.011 | 0.004 | 12.76 | 1180 | 528 | 55.0 |
| 3 | 0.93 | 4.00 | 1.39 | 6.61 | 1.78 | 0.009 | 0.005 | 14.60 | 1180 | 506 | 55.9 |
| 4 | 0.96 | 3.97 | 2.26 | 6.64 | 1.86 | 0.015 | 0.006 | 15.53 | 1180 | 508 | 56.2 |
| 5 | 1.02 | 4.06 | 1.80 | 7.67 | 1.81 | 0.012 | 0.004 | 17.14 | 1180 | 483 | 55.8 |
| 6 | 1.10 | 3.71 | 2.50 | 9.32 | 2.00 | 0.014 | 0.003 | 21.14 | 1190 | 462 | 55.9 |
| 7 | 0.95 | 3.84 | 3.86 | 6.01 | 1.92 | 0.016 | 0.006 | 15.88 | 1190 | 490 | 56.6 |
| 8 | 0.92 | 3.89 | 6.12 | 4.87 | 1.89 | 0.013 | 0.005 | 15.86 | 1190 | 485 | 56.3 |

Next, a 17 × 17 × 8 mm hardness test piece was made out of each 18 × 18 mm square forged bar material to examine the relationship between the amounts of W and Mo and their effect on resistance to softening caused by a tempering. After having been hardened at the hardening temperatures shown in Table 1, the pieces were double tempered at 580° C for 1 hour and further tempered at 650° C for 1 hour and checked for hardness. The results of this test are also shown in Table 1.

The sample No. 1 which contains 0.52% W and 4.28% Mo had a high breaking stress but was not desirable in view of the low hardness after tempering at 650° C. The samples No. 5 and No. 6, each containing more than 7.5% Mo while W + 2Mo being 17.14% and 21.14% respectively, were not desirable either, because of their low traverse bending stresses. Although W + 2Mo is about 16% for the samples No. 7 and No. 8, W contents in these studs exceed 3.5% and traverse bending the stresses were lower, which was not preferrable. The ones that had a stress in excess of 500 kg/mm² and a hardness of over Rc 55 after tempering at 650° C were the samples No. 2, No. 3 and No. 4. This means that when a combination of W and Mo satisfies W 1.0 - 3.2%, Mo 5.5 - 7.5%, as well as the formula $12\% \leqq W + 2Mo \leqq 16\%$, good toughness and excellent resistance to softening effect of heat were obtained. A better combination of W and Mo is the composition range satisfying W 1.2 - 2.5%, Mo 6.5 - 7.4% and $14.1\% \leqq W + 2Mo \leqq 16\%$. The best combination is obtained when W and Mo contents satisfy W 1.5 - 2.3%, Mo 6.6 - 7.2% and $15\% \leqq W + 2Mo \leqq 16\%$.

Second, as to V content. Vanadium forms hard VC carbides and contributes to increased wear resistance. But this effect is not notable when its content is less than 1%. When it exceeds 3.5%, toughness decreases. Therefore, it should be kept within 1 - 3.5%. In view of the balance between toughness and wear resistance, V within a range of 1.1 - 2.0% is better and V 1.3 - 1.9% shows the best results.

Third point is chromium which improves hardenability and increases wear resistance. This effect is not appreciable with less than 3% Cr but when the Cr content exceeds 6% tool performance decreases. From this, it should preferably be within 3 - 6%. It is more preferably be within 3.5 - 5% and most preferably be within 3.5 - 4.5%.

The fourth point is the consideration of the effect of carbon. Carbon is added in proportion to the above-mentioned W, Mo, V, and Cr contents and it gives excellent abrasion resistance, as well as resistance to softening effect of tempering to high speed tool steels. When W, Mo, V, and Cr contents are kept within the range described above, 0.7 - 1.4% C is preferable, for with less than 0.7% C the hardness after tempering was not hard enough and with more than 1.4% C, the hot working properties and toughness were considerably deteriorated. C 0.80 - 1.0% is more preferable and carbon content in the range of 0.86 - 0.96% showed the best effect.

The fifth point is cobalt which substantially increases wear resistance. When upon 19% cobalt is contained in the steel it has a marked effect in cutting hard-to-machine materials. When the Co content exceeds 15%, however, hot workability and toughness decrease remarkably. So it was kept below 15%. Even within the limit of 15%, the higher the Co content is, the lower becomes the toughness. For the purpose of obtaining high toughness, less than 9% Co is more preferable and less than 3% is most preferable.

The sixth consideration is Si and Mn. They are usually added as a deoxidizer, and should be kept below 0.5%. A range of 0.2 - 0.4% is most desirable.

The seventh concerns Ti, Nb, and Zr. So far we have explained that excellent toughness and high resistance to softening effect of tempering are concurrently obtained when the elements, W, Mo, V, Cr, C, Co, Si, and Mn are contained within the limits described above. In addition to this, we have found that a combined addition of Ti, Nb, and/or Zr with N produces better toughness and higher hardness after tempering.

Table 2 shows the chemical compositions of seven different sample steels, each having different Ti, Nb, Zr, and N contents together with the respective traverse bending stresses and hardnesses after tempering at 650° C. The samples No. 4 and No. 16 are the steels selected for comparison, and the rest, No. 9 through No. 15 are the steels in accordance with the present invention. Traverse bending stress ($\sigma_B$) and hardness (Rc) after tempering at 650° C were obtained in the same way as that for Table 1. Hardening temperatures were 1180° C.

Table 2

| No. | C | Cr | W | Mo | V | Co | N | Ti | Nb | Zr | $\sigma_B$ (kg/mm$^2$) | $H_RC$ (650° C) |
|---|---|---|---|---|---|---|---|---|---|---|---|---|
| 4 | 0.96 | 3.97 | 2.26 | 6.64 | 1.86 | — | 0.015 | 0.006 | 0.004 | 0.001 | 508 | 56.2 |
| 9 | 0.93 | 4.12 | 1.40 | 6.52 | 1.68 | 2.03 | 0.028 | 0.038 | 0.002 | 0.002 | 518 | 56.5 |
| 10 | 0.93 | 4.00 | 1.94 | 6.85 | 1.72 | — | 0.033 | 0.004 | 0.002 | 0.035 | 525 | 56.7 |
| 11 | 0.95 | 3.85 | 1.82 | 7.04 | 1.77 | 2.55 | 0.041 | 0.012 | 0.019 | 0.011 | 510 | 56.8 |
| 12 | 0.90 | 3.91 | 1.34 | 5.53 | 1.70 | — | 0.063 | 0.022 | 0.014 | 0.008 | 503 | 56.8 |
| 13 | 0.86 | 4.11 | 1.35 | 6.53 | 1.54 | 7.97 | 0.024 | 0.021 | 0.012 | 0.010 | 507 | 57.0 |
| 14 | 0.94 | 3.85 | 1.24 | 5.90 | 2.20 | 8.10 | 0.090 | 0.032 | 0.044 | 0.014 | 498 | 57.3 |
| 15 | 0.94 | 3.82 | 1.93 | 6.96 | 1.65 | 13.00 | 0.079 | 0.048 | 0.002 | 0.002 | 484 | 57.9 |
| 16 | 0.95 | 3.82 | 1.88 | 6.85 | 1.65 | 2.35 | 0.123 | 0.085 | 0.015 | 0.034 | 468 | 56.5 |

The test result indicates that sample steels No. 9, No. 10, No. 11, No. 12, No. 13, No. 14 and No. 15, each containing 0.02 - 0.1% N and the total of 0.02 - 0.1% of Ti, Nb and Zr, when compared with the steel No. 4 which contains less than 0.02% N and less than 0.02% in total of Ti, Nb and Zr, were higher in both traverse bending stress and in hardness after tempering at 650° C. The effect is greater when the steel contains 0.02 - 0.045% N and 0.02 - 0.045% in total of one or more of Ti, Nb, and Zr. The greatest effect is attained when 0.03 - 0.045% N and 0.02 - 0.045% in total of one or more of Ti, Nb, and Zr are contained. But when N content exceeds 0.1%, toughness deteriorates again and so does hot workability and when the total of Ti, Nb and Zr exceeds 0.1%, toughnesses is again lowered.

Now, the embodiments of the present invention will be explained 10 × 10 × 100 mm single point tools were made using the steels No. 9 through No. 15 having the chemical compositions as shown in Table 2 and in accordance with the present invention, the comparison test steels No. 4 and No. 16, which chemical compositions being also as per Table 2, and the conventional steels falling under AISI M2 and M7. These tools were heat-treated at the temperature shown in Table 3. The hardnesses after heat-treatment are also shown in Table 3.

Table 3

| No. | Hardening temperature | Tempering temperature | Hardness (Rockwell C) | Wear of flank after 15 min. cutting |
|---|---|---|---|---|
| 4 | 1180° C | 560° Cx (1+1+1 )h | 66.0 | 0.72 mm |
| 9 | " | " | 66.2 | 0.52 mm |
| 10 | 1170° C | " | 66.2 | 0.49 mm |
| 11 | 1180° C | " | 66.4 | 0.51 mm |
| 12 | 1170° C | " | 66.5 | 0.58 mm |
| 13 | 1180° C | " | 66.4 | 0.54 mm |
| 14 | " | " | 66.6 | 0.63 mm |
| 15 | " | " | 66.5 | 0.75 mm |
| 16 | " | " | 66.2 | 1.08 mm |
| AISI M2 | 1210° C | " | 66.1 | 0.92 mm |
| AISI M7 | 1190° C | " | 66.2 | 1.03 mm |

After the heat-treatment, a tool angle of 8° - 15° - 6° - 6° - 20° - 15° 14 0.5R was given to each tool. An intermittent cutting test was carried out on these tools using approximately 180 mm dia. AISI 4340 material, having eight grooves of 10 mm width as the material to be used for test machining. This method, which subjects the tool to intermittent impact force, is often employed for comparing the qualities of tools to be used under the condition which are apt to make them break and cause chipping so the tools which wear less in a certain period of cutting time are evaluated to be better in quality. The cutting test conditions were as follows:

Material machined: AISI 4340 (HB 340)
Depth of cut: 1.0 mm

Feed: 0.25 mm/rev.

Cutting speed: 20 m/min.

After 15 minutes' cutting, the amount of wear on the flanks were measured. The result of the test were as shown in Table 3.

The tools made of the steels of this invention, No. 9 through No. 15, each containing 0.02 - 1.0% N and one or more of Ti, Nb and Zr, within 0.02 - 0.1% in total, were less on the flanks than those made of comparison steels and conventional steels. Particularly, No. 9, No. 10 and No. 11, each containing N 0.02 - 0.045% and one or more of Ti, Nb, and Zr, totaling 0.02 - 0.045% wore remarkably less. Of these, No. 10 containing 0.03 - 0.045% N and one or more of Ti, Nb and Zr, 0.02 - 0.045% in total showed the least wear.

No. 11 which contained about 2.5% cobalt were slightly more than No. 10. No. 13 and No. 14 which contained about 8% cobalt wore more than No. 9 through No. 14 but far less than the conventional steels.

It is known from the above that the steels of this invention, containing, by weight percentages C 0.7 - 1.4%, Si 0.5% or less, Mn 0.5% or less, Cr 3 - 6%, W 1 - 3.2%, Mo 5.5 - 7.5, W and Mo being 12% ≦ W + 2Mo ≦ 16%, V 1 - 3.5%, Co 15% or less, N 0.02 - 0.1%, one or more of Ti, Nb and Zr 0.02 - 0.1% in total and the balance being Fe and impurities, are superior to the conventional AISI M2 and M7 type steels in performance of intermittent cutting. It should also be noted that the steel which does not contain cobalt is effective for applications requiring toughness.

Two types of steels of this invention, A and B, and a conventional steel, AISI M7 as shown in Table 4 were made in actual production batches and from these M 10 × 1.5 taps were manufactured and compared for performance in a cutting test.

Table 4

| Type of steel | C | Si | Mn | Cr | W | Mo | V | Co | N | Ti | Nb | Zr |
|---|---|---|---|---|---|---|---|---|---|---|---|---|
| (A) of the present invention | 0.93 | 0.32 | 0.33 | 4.01 | 1.83 | 7.00 | 1.78 | — | 0.038 | 0.021 | 0.002 | 0.011 |
| (B) of the present invention | 0.90 | 0.28 | 0.35 | 3.98 | 1.65 | 7.12 | 1.63 | 5.10 | 0.040 | 0.022 | 0.002 | 0.014 |
| AISI M7 | 0.98 | 0.24 | 0.34 | 4.24 | 1.94 | 8.85 | 1.92 | — | 0.015 | 0.005 | 0.001 | 0.002 |

The test conditions were as follows:

Size of holes for tapping: 8.5 dia. × 20 mm
Cutting length: 20 mm
Cutting speed: 17.6m/min.
Material to be tapped: AISI 4140 ($H_RC$ 35)
Cutting fluid: Water insoluble cutting oil The result of the test is shown in Table 5 in which "number of holes tapped" is the number of holes that each test tap could drilled, from the start of the cutting until its failure.

Table 5

| Type of steel | Hardening temp. | Tempering temp. | Hardness | Number of holes tapped |
|---|---|---|---|---|
| (A) of the present invention | 1180° C | 570° Cx(1+1)h | $H_RC$ 65.0 | 311 |
| (B) of the present invention | " | " | 65.2 | 295 |
| AISI M7 | 1190° C | " | 65.2 | 232 |

As evident from Table 5, the steels of this invention show better performance than the conventional AISI M7 that has long been used for tap material.

We claim:

1. A high speed tool steel having high toughness, consisting essentially of by weight percentages, C 0.7 - 1.4%; Si 0.5% max.; Mn 0.5% max.; Cr 3 - 6%; W 1 - 3.2%, Mo 5.5 - 7.5%, and the relationship between the contents of W and Mo being 12% ≦ W + 2Mo ≦ 16%; V 1 - 3.5%; Co 15% max.; N 0.02 - 0.1%; one or more of the elements selected from the group of Ti, Nb and Zr and being 0.02 - 0.1% in total, the balance being Fe and incidental impurities.

2. A high speed tool steel having high toughness, consisting essentially of by weight percentages, C 0.8 - 1.0%; Si 0.5% max.; Mn 0.5% max.; Cr 3.5 - 5%; W 1.2 - 2.5%, Mo 6.5 - 7.4%, and the relationship between the contents of W and Mo being 14.1% ≦ W + 2Mo ≦ 16%; V 1.1 - 2.0%; Co 9% max.; N 0.02 - 0.045%; either one or more of the elements selected from the group of Ti, Nb and Zr and being 0.02 - 0.045%; in total and the balance being Fe and incidental impurities.

3. A high speed tool steel having high toughness, consisting essentially of by weight percentages, C 0.8 - 1.0%; Si 0.5% max.; Mn 0.5% max.; Cr 3.5 - 5%; W 1.2 - 2.5 %. Mo 6.5 - 7.4%, and the relationship between the contents of W and Mo being 14.1% ≦ W + 2Mo ≦ 16%; V 1.1 - 2.0%; Co 3% max.; N 0.02 - 0.045%; one or more of the elements selected from the group of Ti, Nb and Zr 0.02 - 0.045% in total; and the balance being Fe and incidental impurities.

4. A high speed tool steel having high toughness, consisting essentially of by weight percentages, C 0.86 - 0.96%; Si 0.2 - 0.4%; Mn 0.2 - 0.4%; Cr 3.5 - 4.5%; W 1.5 - 2.3%, Mo 6.6 - 7.2%, and the relationship between the contents of W and Mo being 15% ≦ W + 2Mo ≦ 16%; V 1.3 - 1.9%; Co 3% max.; N 0.03 - 0.045%; one or more of the elements selected from the group of Ti, Nb and Zr and 0.02 - 0.045% in total; and the balance being Fe and incidental impurities.

5. A high speed tool steel having high toughness, consisting essentially of by weight percentages, C 0.8 - 1.0%; Si 0.5% max.; Mn 0.5% max.; Cr 3.5 - 5%; W 1.2 - 2.5%, Mo 6.5 - 7.4%, and the relationship between the contents of W and Mo being 14.1% ≦ W + 2Mo ≦ 16%; V 1.1 - 2.0%; N 0.02 - 0.045%; one or more of the elements selected from the group of Ti, Nb and Zr, and being 0.02 - 0.045% in total; and the balance being Fe and incidental impurities.

* * * * *